US006191375B1

(12) United States Patent
Cardona et al.

(10) Patent No.: US 6,191,375 B1
(45) Date of Patent: Feb. 20, 2001

(54) ELECTRICAL SWITCH HAVING IMPROVED RELIABILITY ELECTRICAL CONTACTS AND ELECTRICAL CONTACTS THEREFOR

(75) Inventors: Dario A. Cardona, Dorchester; Louis J. Leyes, North Attleboro, both of MA (US)

(73) Assignee: Texas Instruments Incorporated, Dallas, TX (US)

( * ) Notice: Under 35 U.S.C. 154(b), the term of this patent shall be extended for 0 days.

(21) Appl. No.: 09/468,259

(22) Filed: Dec. 20, 1999

(51) Int. Cl.[7] ..... H01H 1/06

(52) U.S. Cl. ..... 200/248; 200/246; 200/271; 200/275

(58) Field of Search ..... 200/239, 240, 200/244–246, 248, 258, 275, 279, 283, 286, 287, 405, 407, 408

(56) References Cited

U.S. PATENT DOCUMENTS 3,189,721 * 6/1965 Lee ..... 200/166
3,283,108 * 11/1966 Collier ..... 200/166
3,502,836 * 3/1970 Woolley ..... 200/166
3,962,659 * 6/1976 Kawase et al. ..... 335/196
5,391,847 * 2/1995 Gallone ..... 200/244
6,043,440 * 3/2000 Sun et al. ..... 200/51.04

OTHER PUBLICATIONS

Ney Contact Manual published by Pitney (Electrical Contacts for Low Energy Uses), copyright 1973.

* cited by examiner

*Primary Examiner*—Michael Friedhofer
(74) *Attorney, Agent, or Firm*—Russell E. Baumann; Frederick J. Telecky, Jr.

(57) ABSTRACT

An electrical switch (10) has a contact system in which first and second contact protrusions (22*a*, 22*b*; 22*a'*, 22*b'*; 22*a"*, 22*b"*) are offset from the center line of the long axis of a twistable movable contact arm. In a preferred embodiment the movable contact (22) is formed with a groove (22*e*, 22*e'*) formed through the contact running generally along the center line to form first and second generally wedge shaped contacts on either side of the center line. In one preferred embodiment, converging surfaces (22*f*, 22*g*) form a groove with an angle alpha of approximately 125° and approximately 158° in another preferred embodiment. In another preferred embodiment the protrusions (22*a"*, 22*b"*) are generally hemispherical.

6 Claims, 5 Drawing Sheets

ELECTRICAL SWITCH HAVING IMPROVED RELIABILITY ELECTRICAL CONTACTS AND ELECTRICAL CONTACTS THEREFOR

FIELD OF THE INVENTION

This invention relates generally to electrical switches and more particularly to such switches having improved reliability in closing a circuit path upon contact engagement of a movable electrical contact with a stationary electrical contact and to electrical contacts which provide such improved reliability.

BACKGROUND OF THE INVENTION

There are many applications in which a condition is sensed, for example, pressure of a fluid source, by a condition sensing device which provides an electrical signal upon the occurrence of a selected change in the condition; for example, a dished shaped diaphragm placed in fluid receiving relationship with a fluid pressure source to sense a change in fluid pressure. The diaphragm moves a motion transfer member when the diaphragm moves from one dished shaped configuration to an opposite dished shaped configuration with the motion transfer member applying a force to a movable contact arm, carrying a movable electrical contact, causing the movable contact to move into contact engaging relation with a stationary electrical contact to close a circuit path thereby providing an indication of the change in fluid pressure. Reliability of circuit closure is essential to ensure that the pressure indicator of the system using the pressure source operates as intended. A potential problem which can interfere with normal switch operation is for a small, e.g., microscopic, particulate contamination to find its way on the surface of the contacts at the point of engagement thereby preventing electrical closure of the circuit path even though the contacts have moved into physical engagement with one another. Although the problem normally occurs very rarely, for example, on the order of about 100 ppm, i.e., a 1 in 10,000 probability, this is considered to be unsatisfactory with regard to present day manufacturing standards where zero ppm is the goal.

In order to improve reliability, it is known to provide switches having multiple contact wipers, i.e., essentially a plurality of movable contact arms acting in electrical parallel, wherein the probability of having at least one contact wiper free of contaminants is essentially infinite; however, typically this involves some type of mechanical and electrical interconnection structure as well as a means for providing sufficient force to actuate the multiple wipers. This may be suitable for a more expensive and larger electrical switching systems but is not suitable in low cost indicator switches.

SUMMARY OF THE INVENTION

It is an object of the present invention to provide an electrical switch free of the above noted prior art limitations. Another object is the provision of an electrical switch having improved reliability which is low in cost and simple and compact in structure and to electrical contacts for such switches.

Briefly stated, an improved reliability electrical switch and improved reliability electrical contacts for such switches comprises a switch having a movable contact arm mounting a movable contact thereon with the movable contact movable into and out of engagement with a stationary contact. According to a preferred embodiment of the invention, the movable contact arm is an elongated, twistable arm having a center line along the long, or longitudinal axis, and being cantilever mounted with the movable contact having a base with first and second protrusions extending from the base formed on opposite sides of the center line. A force transferred through the movable contact arm will cause the movable contact to move into engagement with the stationary contact with both protrusions coming into contact therewith. If a contaminant is disposed at one of the switching points a moment in the direction of the second uncontaminated point will be generated taking advantage of the natural torsional flexibility of the contact arm with the second contact point forced into electrical engagement with the stationary contact thereby closing the circuit path between the contacts. The probability of contaminants occurring at both contact points decreases from approximately 1 in 10,000 to approximately 1 in 100,000,000. According to a preferred embodiment, a groove is formed in the movable contact by two converging surfaces, the groove extending along and in the direction of the center line of the long axis of the movable contact arm. According to one embodiment the angle formed by the two surfaces is approximately 125° while in a second embodiment the angle is approximately 158°. According to another preferred embodiment, the movable contact is formed with first and second generally semi-hemispheric protrusions spaced from one another on opposite sides of the center line of the long axis of the contact arm.

DETAILED DESCRIPTION OF THE PREFERRED EMBODIMENTS

Figure 1:
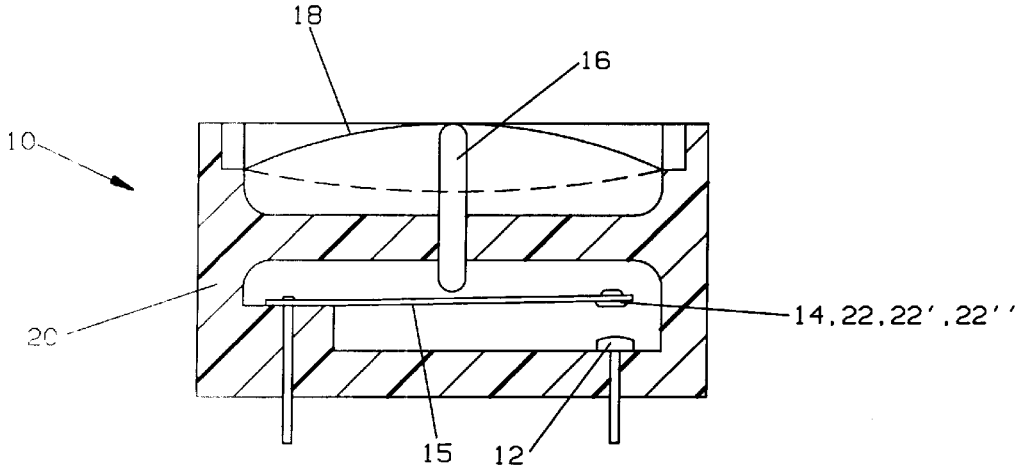
FIG. 1 is a schematic cross sectional side elevational diagram of a condition responsive electrical switch in which conventional switch contacts can be used as well as one in which contacts made in accordance with the invention can be used.
Figure 2:
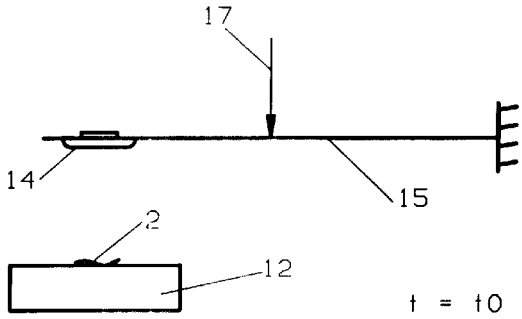
PRIOR ART FIG 2
FIG. 2 is a side view of a typical single point contact system in the normally open position with a contaminant disposed on the stationary contact at the contact point.
Figure 2A:
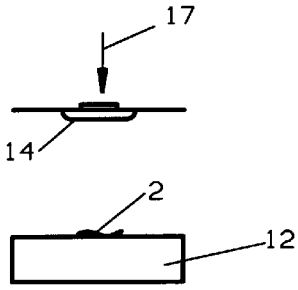
PRIOR ART FIG 2a
FIG. 2*a* a simplified end view of the FIG. 2 system.
Figure 3:
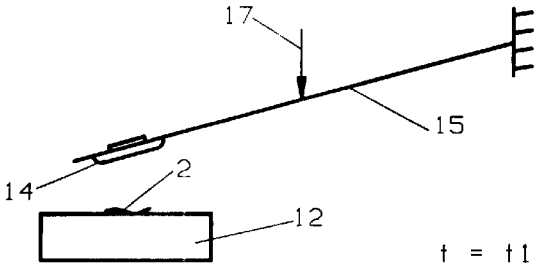
PRIOR ART FIG 3
FIG. 3 is a side view of the FIG. 2 system in transition between open and closed positions.
Figure 3A:
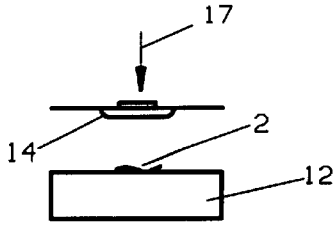
PRIOR ART FIG 3a
FIG. 3*a* is a simplified end view of the FIG. 3 structure.

With reference to FIG. 1, an electrical switch 10 is shown, by way of example, in which a stationary contact 12 is mounted in a housing 20 which also mounts a conventional movable contact 14 mounted on the distal free end of an elongated flexible and twistable contact arm 15 which in turn is cantilever mounted in housing 20. Movable contact 14 is shown to be a normally open contact; however, it could also be a normally closed contact. A condition responsive element in the form of a dished shaped diaphragm 18 is adapted to be placed in pressure sensing relation with a fluid pressure source (not shown) so that upon occurrence of a selected increase in pressure the diaphragm will move to its oppositely dished configuration (dashed lines) causing motion transfer pin 16 to move downwardly, as shown, in turn driving the movable contact arm downwardly and the movable contact into engagement with stationary contact 12 to close a circuit path between the two contacts.

Figure 4:
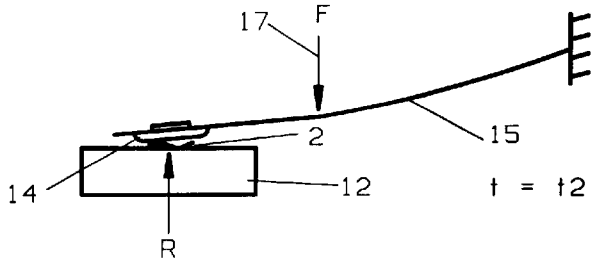
PRIOR ART FIG 4
FIG. 4 is a side view of the FIG. 2 system in the actuated or closed position but without electrical continuity between the movable and stationary contacts due to the presence of the contaminant.
Figure 4A:
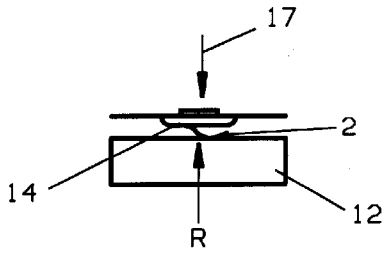
PRIOR ART FIG 4a
FIG. 4*a* is a simplified end view of the FIG. 4 structure.

With respect to FIGS. 2–4*a,* a conventional single point contact system is shown. The contact system is used in various switches such as the one depicted in FIG. 1 where a force F is applied in the direction of arrow 17 through motion transfer pin 16 upon movement of diaphragm 18 to the dashed line position. If a contaminant 2 is disposed at the contact point between the movable and stationary contacts 14, 12, e.g., on stationary contact 12 as shown in the drawings, the contaminant can prevent electrical continuity when the movable contact moves to the contacts closed position as shown in FIGS. 4, 4*a.*

Figure 5:
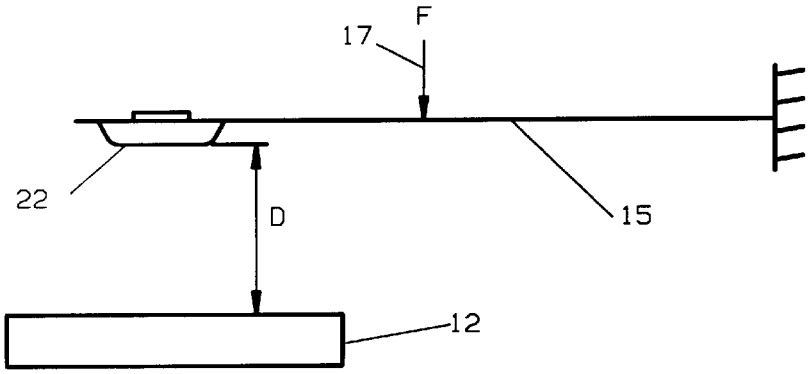
FIG. 5 is an enlarged side view of an improved contact system made in accordance with the invention in the normally open position.
Figure 5A:
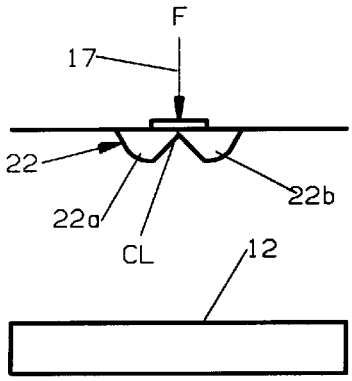
FIG. 5*a* is a simplified end view of the FIG. 5 structure.
Figure 6:
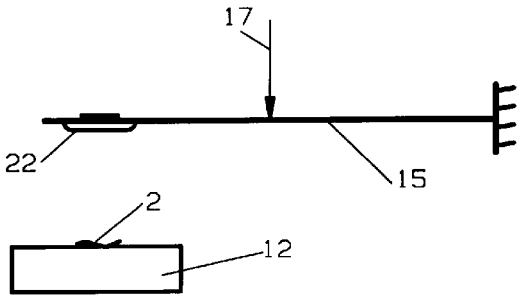
FIG. 6 is a side view, similar to FIG. 2, of the improved contact system made in accordance with the invention in the open position and with a contaminant at one of two contact points of the system.
Figure 6A:
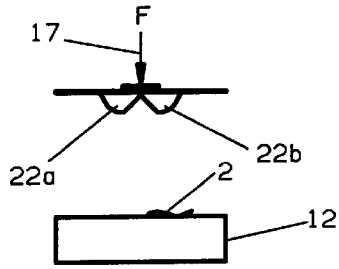
FIG. 6*a* is a simplified end view of the FIG. 6 structure.
Figure 7:
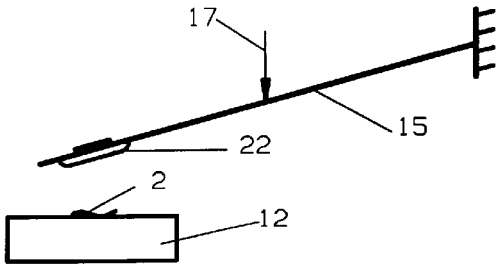
FIG. 7 is a side view, similar to FIG. 3, of the improved contact system in a transition stage.
Figure 7A:
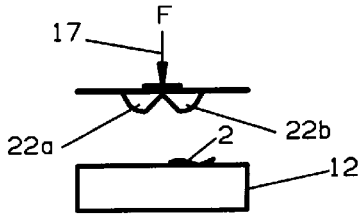
FIG. 7*a* is a simplified end view of the FIG. 7 structure.
Figure 8:
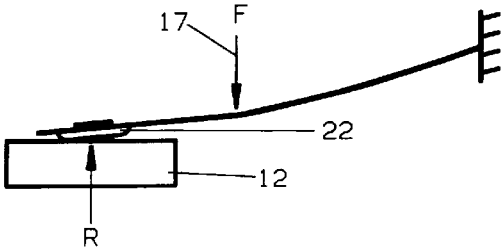
FIG. 8 is a side view similar to FIG. 4 of the improved contact system in the actuated position.
Figure 8A:
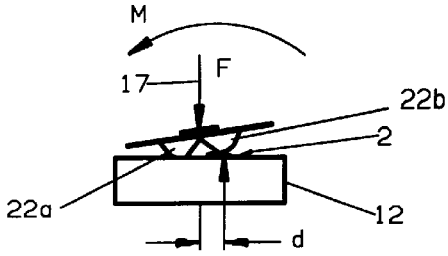
FIG. 8*a* is a simplified end view of the FIG. 8 structure.

In a contact system made in accordance with the invention, however, at least two contact points are provided so that a contaminant disposed at one of the contact points will not prevent electrical continuity through the contacts upon contact closure. As shown in FIGS. 5 and 5*a,* contact 22 is provided with first and second protrusions 22*a,* 22*b* located on opposite sides of the center line CL of the length of elongated, flexible movable contact arm 15 which is cantilever mounted for movement through distance D toward stationary contact 12 upon the application of force F. With reference to FIGS. 6–8*a,* if contaminant 2 is disposed at one of the contact points of a two contact system in which the two contact points are offset from center line CL, e.g., in alignment with contact protrusion 22*b* as shown, when contact protrusion 22*b* engages the contaminant upon contact closure a counterclockwise movement M is generated causing contact arm 15 to twist in a counterclockwise direction resulting in contact protrusion 22*a* making electrical connection with stationary contact as best seen in FIG. 8*a*. It will be seen from the figure that force F is offset from reaction R at the location of contaminant 2 a distance of which creates a counterclockwise movement M which causes movable contact arm 15 to twist with protrusion 22*a* electrically engaging stationary contact 12.

Figure 9:
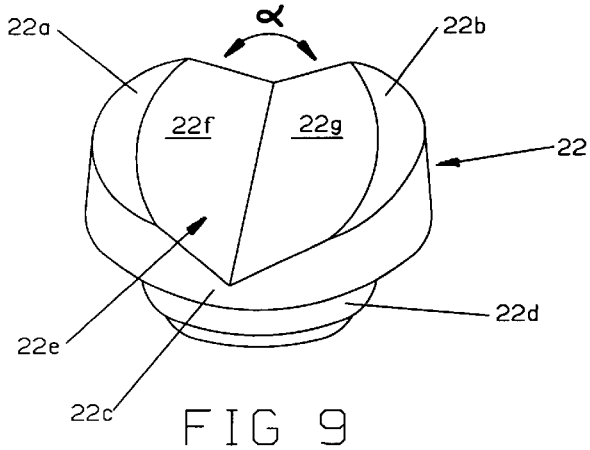
FIG. 9 is a perspective of a movable contact similar to that of FIGS. 5, 5*a;*

More particularly, with respect to FIG. 9, contact 22 has a base portion 22*c* with first and second upwardly extending (as shown in the drawing) elongated protrusions 22*a,* 22*b.* A conventional weld projection 22*d* is preferably provided, extending downwardly, to facilitate attachment to a movable contact arm, such as arm 15 shown in the previously described drawings. A groove 22*e* is formed in the contact by converging surfaces 22*f,* 22*g,* respectively, forming an angle alpha. Contact 22 is made with a suitable registration means so that groove 22*e* will extend in a direction of the longitudinal axis of a movable arm on which contact 22 is mounted with the protrusions offset on either side of the center line of the movable arm, as shown in FIGS. 5, 5*a.* Contacts were made as shown in FIG. 9 with angle alpha of approximately 125° in one embodiment which proved to be effective. In another embodiment the contacts of FIG. 9 were made having an alpha angle of approximately 158° which was also effective.

Figure 10:
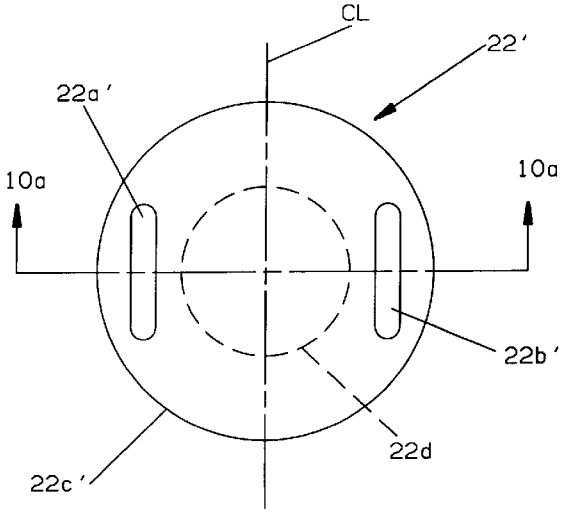
FIG. 10 is a top plan view of a movable contact made in accordance with a modified embodiment of the invention.
Figure 10A:
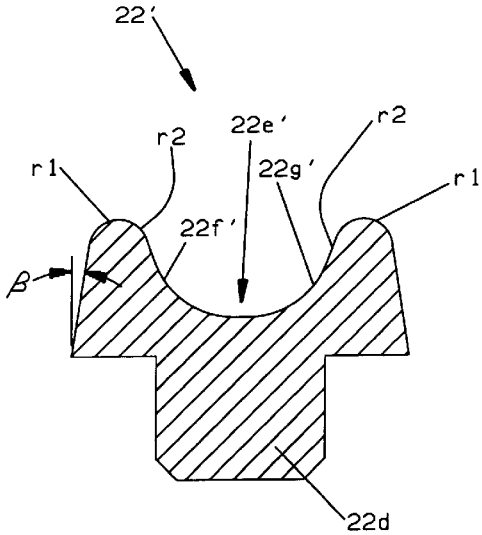
FIG. 10*a* is a cross sectional view taken on line 10*a*—10*a* of FIG. 10.

In FIGS. 10 and 10*a,* a slightly modified embodiment is shown in which contact 22' is formed with first and second elongated protrusions 22*a*', 22*b*' which extend generally parallel to each other on either side of center line CL and with a groove 22*e*' formed by converging curved surfaces 22*f,* 22*g*'. Base 22*c*' and protrusions 22*a*', 22*b*' are formed with an angle beta of approximately 10°, that is, essentially a taper of the base 22*c*' which is continued, with the outer peripheral portions of protrusions 22*a*', 22*b*'. Contacts 22' were made as shown in FIGS. 10, 10*a* having a base portion 22*c*' having a diameter of 0.125 inches, an angle beta of approximately 10° and with a radius of r1 at the upper portion of the protrusions of 0.010 inch and an inner radius r2 of 0.037 inch.

Figure 11:
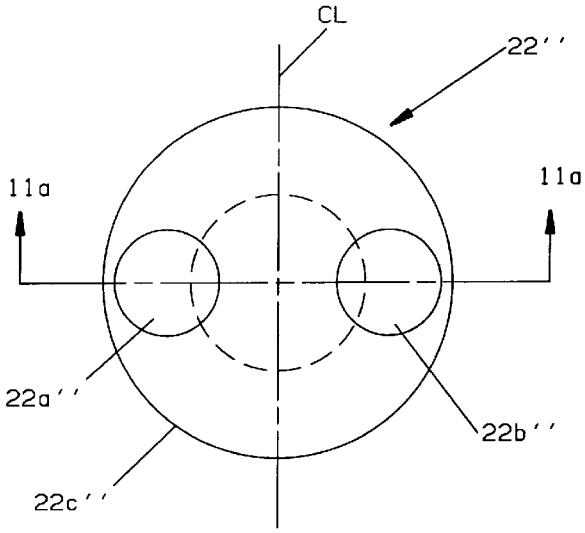
FIG. 11 is a top plan view of a movable contact made in accordance with another embodiment of the invention.
Figure 11A:
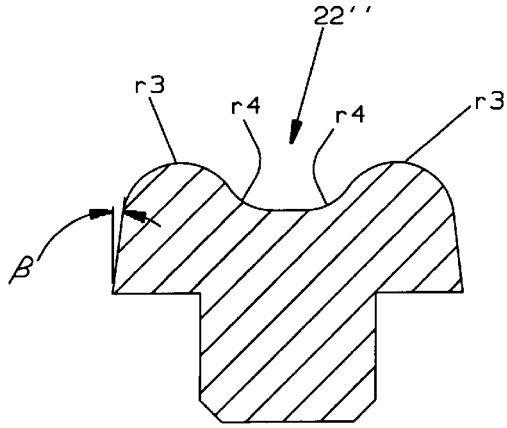
FIG. 11*a* is a cross sectional view taken on line 11*a*—11*a* of FIG. 11.

In FIGS. 11 and 11*a,* contact 22" is formed with first and second generally hemispherical protrusions 22*a*", 22*b*" offset on opposite sides of center line CL. Contacts 22" were made as shown in FIGS. 11, 11*a* having a base portion 22*c*" diameter of 0.125 inch, an angle beta of approximately 10° and a radius r3 of the hemispherical portions of approximately 0.020 inches and with an inside radius r4 of approximately 0.018 inch.

It should be understood that although particular embodiments of the invention have been described by way of illustrating the invention, the invention includes all modifications and equivalents of the disclosed embodiment falling within the scope of the appended claims.

What is claimed:

1. An electrical switch having a housing, a stationary electrical contact mounted on the housing, having a generally twistable movable contact arm cantilever mounted in said housing having first and second ends with a center line therebetween, a movable contact mounted on the movable contact arm movable into and out of engagement with the stationary contact, the movable contact having a base portion and having first and second protrusions extending in a direction generally toward the stationary contact, the first and second protrusions aligned with the stationary contact and being disposed on opposite sides of the center line so that movement of the movable contact into engagement with the stationary contact will bring both first and second protrusions into engagement with the stationary contact and whereby if a contaminant is disposed between the stationary contact and one of the first and second protrusions the movable arm will twist allowing the other of the first and second protrusions to move into electrical engagement with the stationary contact.

2. An electrical switch according to claim 1 in which the first and second protrusions are generally hemispherical in configuration.

3. An electrical switch according to claim 1 in which the first and second protrusions are formed by converging surfaces forming a groove between the protrusions, the groove extending in a direction generally along the center line.

4. An electrical switch according to claim 3 in which said groove formed by the converging surfaces is at an angle of approximately 125° between said surfaces.

5. An electrical switch according to claim 3 in which said groove formed by the converging surfaces is at an angle of approximately 158° between said surfaces.

6. An electrical switch according to claim 3 in which the converging surfaces are curved.

* * * * *